US009162150B2

(12) United States Patent
Roodenburg et al.

(10) Patent No.: US 9,162,150 B2
(45) Date of Patent: Oct. 20, 2015

(54) PIVOTABLE PASSENGER CARRIER

(75) Inventors: Joop Roodenburg, Delft (NL); Sjoerd Jacco Sintenie, Roermond (NL)

(73) Assignee: VEKOMA RIDES ENGINEERING B.V., Vlodrop (NL)

( * ) Notice: Subject to any disclaimer, the term of this patent is extended or adjusted under 35 U.S.C. 154(b) by 304 days.

(21) Appl. No.: 13/824,298

(22) PCT Filed: Sep. 23, 2010

(86) PCT No.: PCT/NL2010/050618

§ 371 (c)(1),
(2), (4) Date: May 31, 2013

(87) PCT Pub. No.: WO2012/039601

PCT Pub. Date: Mar. 29, 2012

(65) Prior Publication Data

US 2013/0233198 A1 Sep. 12, 2013

(51) Int. Cl.
*A63G 7/00* (2006.01)

(52) U.S. Cl.
CPC ..... *A63G 7/00* (2013.01)

(58) Field of Classification Search
CPC ..... A63G 7/00; A63G 9/00; A63G 9/02; A63G 9/04; A63G 9/08; A63G 21/08; A63G 23/00
USPC ..... 104/27, 28, 53, 55, 63, 64, 74, 75, 76
See application file for complete search history.

(56) References Cited

U.S. PATENT DOCUMENTS 428,385 A * 5/1890 Emery ..... 104/28
3,675,584 A * 7/1972 Hall ..... 104/28
4,775,029 A * 10/1988 MacDonald et al. ..... 182/2.1
5,249,643 A * 10/1993 Backer et al. ..... 182/2.11
5,403,238 A 4/1995 Baxter et al.
D399,628 S * 10/1998 Smith ..... D34/28
6,113,500 A * 9/2000 Francis et al. ..... 472/60
8,630,734 B2 * 1/2014 Hasenzahl ..... 700/245
2003/0172834 A1 * 9/2003 De-Gol ..... 104/53
2006/0191406 A1 * 8/2006 Kucher et al. ..... 92/5 R
2008/0173208 A1 7/2008 Heinrich

FOREIGN PATENT DOCUMENTS

CN 201279386 Y 7/2009
DE 10 2007 001 881 A1 7/2008
WO WO 2007/055572 A1 5/2007
WO WO 2009/006480 A1 1/2009

* cited by examiner

*Primary Examiner* — Mark Le

(74) *Attorney, Agent, or Firm* — Birch, Stewart, Kolasch & Birch, LLP

(57) ABSTRACT

An amusement ride vehicle for transporting multiple passengers is provided. The vehicle includes a movable base, a support, a lift arm and a carrier. The support is mounted on the movable base. The lift arm is pivotably connected to the support at one end and pivotably connected to the carrier at its opposite end. The carrier is provided with multiple passenger seats and includes a restraining device adapted to restrain each individual passenger in a seat. The vehicle is further provided with a first actuator for pivoting the lift arm relative to the support, and thus for lifting and lowering the carrier relative to the movable base while the movable base rides over the substructure, and a second actuator for pivoting the carrier relative to the lift arm, and thus for adjusting the pitch of the carrier relative to the movable base while the movable base rides over the substructure.

25 Claims, 8 Drawing Sheets

PIVOTABLE PASSENGER CARRIER

BACKGROUND OF THE INVENTION

1. Field of the Invention
2. Description of Background Art

The invention relates to an amusement ride vehicle for transporting multiple passenger and to an amusement ride.

SUMMARY OF THE INVENTION

Amusement rides and amusement ride vehicles for transporting multiple passengers are well known from the prior art. For example U.S. Pat. No. 5,403,238 discloses an amusement ride vehicle, which vehicle comprises a chassis for driving along a track, and a body for supporting multiple passengers. The body of the vehicle is movably mounted on the chassis. It is supported by multiple actuators, more in particular hydraulic cylinders, which support the weight of the body. By controlling the extension of the different cylinders, the body can be lifted and its pitch relative to the chassis can be adjusted. The movement of the body relative to the chassis is used to increase the sense of excitement of the passengers during the ride.

It is an object of the invention to provide an alternative amusement ride vehicle. A further object of the invention is to provide an amusement ride vehicle and an amusement ride which provide an enhanced sense of excitement. A further object of the invention is to provide an amusement ride vehicle with a simple construction, which is able to transport multiple passengers, and to lift and pitch those passengers.

The invention therefore provides an amusement ride vehicle and an amusement ride.

The amusement ride vehicle comprises a movable base adapted to ride over a substructure, for example a support surface, rails or track. A carrier, supporting multiple passenger seats, is connected via a lift arm to a support which is mounted on the movable base.

The lift arm is pivotably connected to the support for pivoting relative to the support about a horizontal axis. The carrier in turn is pivotably supported by the lift arm for pivoting relative to the lift arm about a horizontal axis.

The carrier supports multiple passenger seats. It comprises a restraining device adapted to restrain each individual passenger in a seat. By pivoting the lift arm the carrier is lifted and lowered relative to the movable base, and by pivoting the carrier relative to the lift arm the pitch of the carrier relative to the movable base can be adjusted.

A first actuator is provided for pivoting the lift arm relative to the support, and thus for lifting and lowering the carrier relative to the movable base, while the movable base moves along the track. A second actuator is provided for pivoting the carrier relative to the lift arm, and thus for adjusting the pitch of the carrier relative to the movable base, while the movable base moves along the track.

The carrier has a neutral position in which the passenger seats are supported in an upright position relative to the movable base. When the vehicle is in a station and the passengers are boarding and/or disembarking, the seats are in this upright position. During the ride, the carrier can be pivoted relative to the neutral position into a pitched forward position, in which the seats are tilted forward, and/or into a pitched backward position, in which the seats are tilted backward, to enhance the sense of excitement of the passengers.

Thus, the passengers of a vehicle according to the invention can be lifted and lowered, pitched forward and/or backward during the ride. The passengers are moved and positioned relative to and in connection with the scenery of the attraction to enhance their experience of the attraction.

With a vehicle according to the invention the carrier is supported by the lift arm, which in turn is connected to the support. The use of a lift arm allows for a greater range of movement compared to a carrier which is directly supported by the actuators. The range of movement of the carrier is not linked by the reach of the actuators in extended position.

Furthermore, due to the use of a lift arm, compact actuators can be used which in turn allows for a small and light construction of the vehicle. In a preferred embodiment, the lift arm functions as a lever and an increased range of movement is obtained.

Furthermore, the lift and pitch of the carrier can each be adjusted with their own actuator. For adjusting the vertical position of the carrier the first actuator is used, for adjusting the pitch the second actuator. Thus, controlling the position of the carrier is simple.

Furthermore, the actuator for controlling the pitch of the carrier does not support the weight of the carrier. Therefore, it can be relatively light and quick compared to the heavy duty controllers needed for supporting a carrier.

Preferably, the support is mounted rotatably on the movable base for rotating about a vertical axis to further enhance the experience of the passengers.

In a further embodiment of a vehicle according to the invention, the seats in the pitched forward position are at an angle of 25 degrees or more, preferably of about 30 degrees, relative to the seats when in the neutral position, and a pitched backward position in which the seats are at an angle of 30 degrees or more, preferably of about 35 degrees relative to the seats when in the neutral position.

A forward pitch of 15 degrees, preferably of 25 degrees or more, relative to the neutral position excites the passengers and creates an enhanced experience of the ride. Preferably the carrier can be pitched forward as well as backward. Preferably, the seats can be pivoted backward over an angle of 30 degrees or more. Test have shown that at smaller angles passengers tend to keep their head up right, which prevents them from optimally experiencing the pivoted position. When pivoted backward over 30 degrees or more, passengers tend to rest their had on the headrests.

In a further preferred embodiment, the carrier is pivotable over an overall angle of 30 degrees or more, preferably of 50 degrees or more, to provide the passengers with a further enhanced experience.

In a further embodiment, the pivot axis connecting the lift arm with the support is fixed at a constant height above the movable base, and the pivot axis connecting the carrier and the lift arm can be lowered to a position below the fixed pivot axis, and can be lifted to a position above the fixed pivot axis connecting the support and the lift arm.

Due to the lifting an lowering of the carrier with a pivotable lift arm, the centre of gravity of the vehicle moves along an arc shaped trajectory while the carrier is lifted or lowered. By providing the point about which the lift arm is pivoted at a fixed height above the movable base, and in-between the lowest and highest position of the carrier, the movement of the centre of gravity of the carrier in a horizontal direction is limited, which improves the stability of the vehicle. In a preferred embodiment, the point about which the lift arm is pivoted is located about halfway in-between the lowest and the highest position of the carrier.

In a further embodiment, the support is a support arm, which support arm is mounted on the movable base such that its longitudinal axis extends at an angle relative to a vertical axis. Thus the support is compact and light, which increases the movability of the vehicle.

In a further embodiment, the vehicle is provided with a pitch adjustment boom. The boom is at one end pivotably connected to the carrier and at its opposite end to the actuator for pivoting the carrier. The pitch of the carrier can be adjusted by moving the boom along its longitudinal axis with the actuator. The actuator for adjusting the pitch of the carrier can thus be located on the lift arm at a distance from the carrier, thus the actuator is not lifted and or lowered in the same degree as the carrier, and the power needed to lift the carrier is reduced. In a preferred embodiment, the actuator is even mounted on the support in stead of on the lift arm. Thus the actuator does not need to be lowered or lifted when lowering or lifting the carrier. Thus an actuator with a smaller workload, which is thus lighter and/or less expensive and/or acts quicker, can be used for lifting the carrier.

In a further embodiment, the pitch adjustment boom is connected to the actuator for pivoting the carrier via a linkage member, which linkage member is pivotably connected to the pitch adjustment boom and to the actuator for pivoting the carrier, and is furthermore pivotably connected to the support, more preferably to the pivot axis connecting the lift arm to the support. Thus a kinematic linkage system is created, comprising the lift arm, the carrier, the pitch adjustment boom and the linkage member, which linkage system keeps the carrier at a substantially constant pitch during lifting and lowering. Thus controlling the pitch of the carrier, especially during lifting and lowering, is facilitated.

In a further embodiment the second actuator comprises a pneumatic cylinder, a hydraulic cylinder or an electric cylinder, connected with one end to the linkage member and with its opposite end to the support.

In a further embodiment, the first actuator, i.e. the actuator for lifting the carrier, comprises a hydraulic, a pneumatic cylinder or a hydraulic cylinder, connected with one end to the support and with its opposite end to the lift arm. In a preferred embodiment, the lift arm is with one end connected to the carrier and with its opposite end to the actuator for pivoting the lift arm, and the two ends of the lift arm are located on opposite sides of the pivot axis of the lift arm. Thus, in the lowered position, the lift arm is positioned at one side of the support and the cylinder at the opposite side of the support. Thus the lift arm can be located adjacent the support, and can be folded in-between the carrier and the support, which allows for a compact and thus stable configuration of the vehicle.

In a further embodiment, the pivot axis connecting the lift arm to the carrier is located near the centre of the carrier, when seen in side view, such that when the carrier is pivoted, one end of the carrier moves in a direction opposite to the direction of movement of the opposite end of the carrier. Preferably, the pivot axis connecting the carrier to the lift arm is located near, preferably intersects, the centre of gravity of the carrier. Thus, the force needed for pivoting the carrier about the pivot axis is limited.

In a further embodiment, the support is provided with a guide surface, more preferably a cam track, for guiding the carrier into its neutral position while being lowered into its lowest position. Thus the carrier is guided in the position for boarding and disembarking passengers, which preferably takes place with the carrier in its lowest position.

In a further embodiment, when the carrier is in its lowest position, the lift arm is folded in-between the support and the carrier. Thus the vehicle, more in particular the support, lift arm and carrier are in compact and stable configuration when the carrier is in the carrier is in its lowest position.

In a further embodiment, the vehicle is provided with a drive for driving the vehicle over the substructure, preferably for driving the vehicle over the substructure along a track throughout an amusement attraction, more preferably for engaging a guide rail and for driving the movable base over a track along the guide rail. By providing the vehicle with its own drive, vehicles do not need to be linked to a driven vehicle and/or each other in a train like fashion, but can move independent over the substructure.

In a further embodiment, the vehicle comprises a computer control unit for controlling the first and second actuator, and preferably the drive of the vehicle and/or the angle of rotation of the support, preferably in dependence of at least one variable such as the location of the vehicle, the distance traveled by the vehicle, or the time lapsed since start of the ride.

The invention furthermore provides an amusement ride comprising multiple passenger carriers according the invention, a track preferably a closed loop track, for said passenger carriers, and a station along the track where the ride begins and/or ends, for boarding and/or disembarking of the one or more vehicles by the passengers.

Preferably, the vehicles are provided with a rotatably mounted support on the movable base for rotating the stand about a vertical axis to position the stands such that the passengers sitting in the seats of a first vehicle face the passengers sitting in a second vehicle and visa versa. Watching the excitement of the passengers in the other vehicle enhances the experience of the ride.

In a further embodiment, the track of the amusement ride comprises an inner track and an outer track such that a first vehicle riding the inside track can ride next to a second vehicle riding the outside track. Preferably, the inside and outside track are located within the station, which is designed for receiving the vehicles for disembarking and/or boarding, with the stand of a vehicle in the inner track positioned such that the passengers sitting in the seats face the passengers sitting in the vehicle on the outer track and visa versa. Thus the passengers see the anticipation and excitement of the passengers of the other vehicle which further enhances the experience of the ride.

In a further embodiment, the outer track is longer than the inner track or visa versa, and the station is located halfway the inner track and halfway the outer track, such that a vehicle which leaves the station on the outer track and enters the station on the inner track travels the same distance as a vehicle which leaves the station on the inner track and enters the station on the outer track. When a vehicle on the inner track and a vehicle on the outer track leave the station at the same moment and follow the track with the same speed, they will travel the single track one behind the other and return at the station at the same moment.

In an alternative embodiment, the outer track and the inner track are of equal length, and the track lay out is such that the length of the inner track between the station to the single track is larger than the length of the outer track between the station to the single track, or visa versa, such that when a vehicle on the inner track and a vehicle on the outer track leave the station at the same moment and follow the track with the same speed, they will travel the single track one behind the other and return at the station at the same moment.

Thus the passengers see the anticipation and excitement of the passengers of the other vehicle when they start and end the ride, which further enhances the experience of the ride.

Further objects, embodiments and elaborations of the apparatus and the method according to the invention will be apparent from the following description, in which the invention is further illustrated and elucidated on the basis of a number of exemplary embodiments, with reference to the drawings.

DETAILED DESCRIPTION OF THE INVENTION

Figure 1:
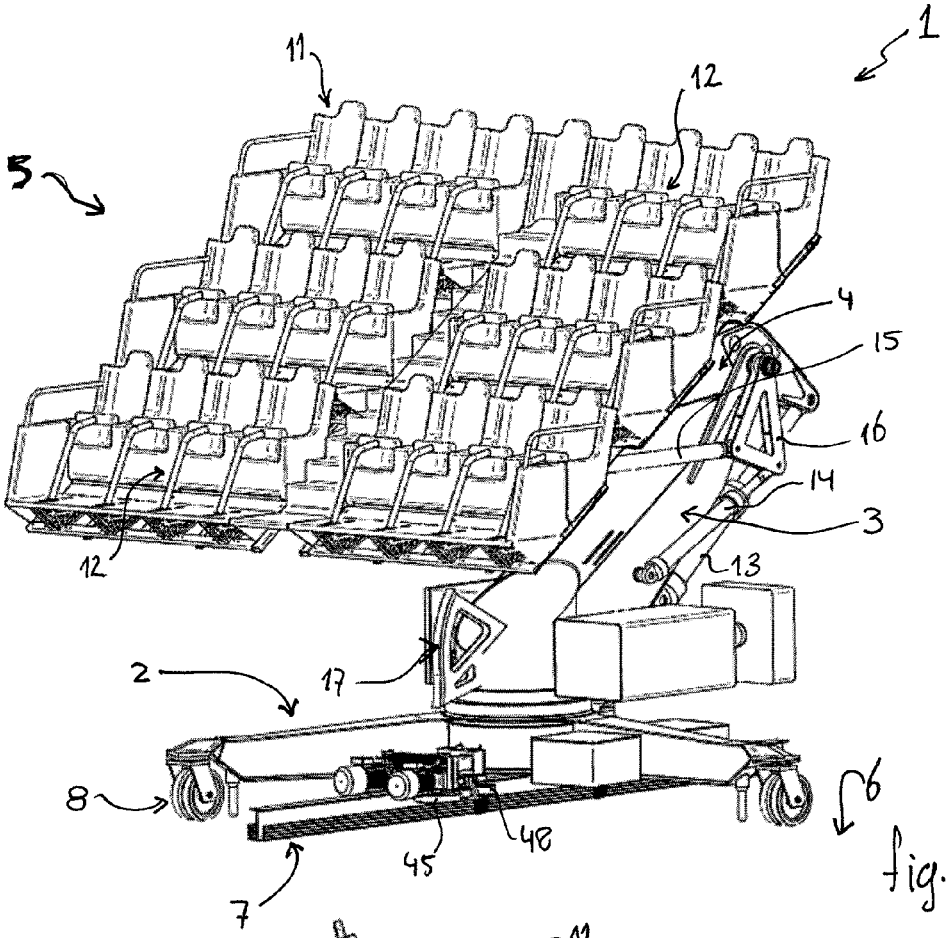
FIG. 1 schematically shows a perspective view of an exemplary embodiment of a vehicle according to the invention.
Figure 2:
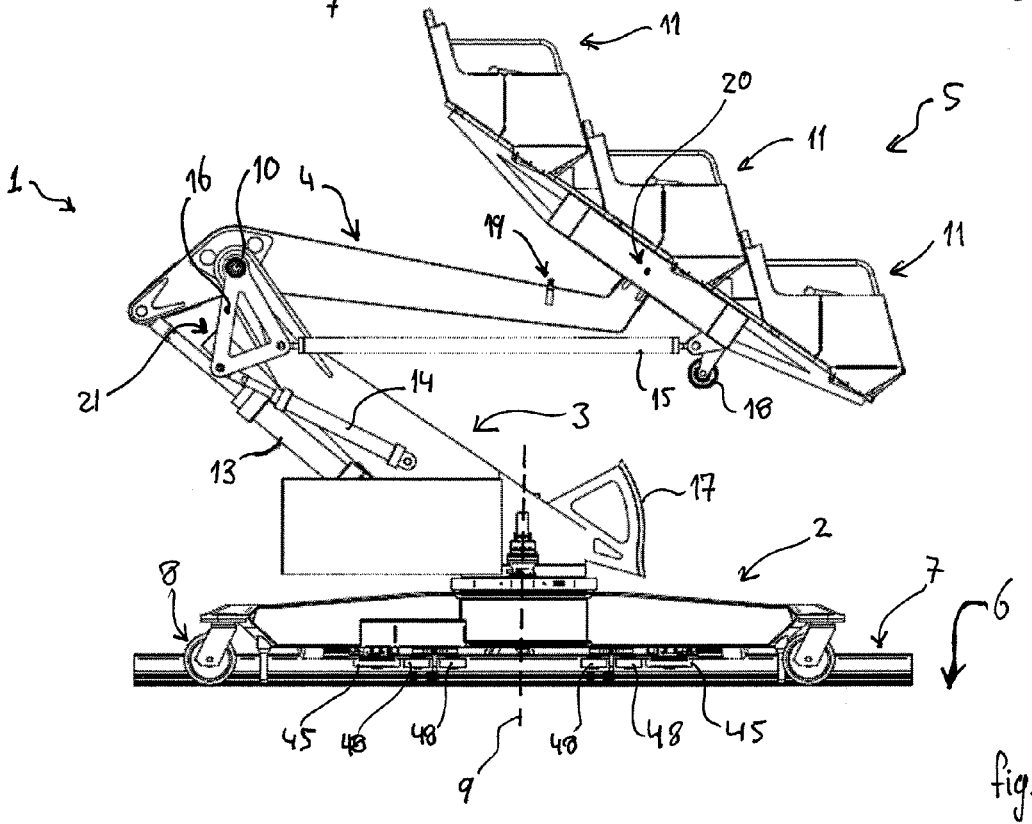
FIG. 2 schematically shows a side view of the vehicle from FIG. 1 with the carrier in a lifted and neutral position.

FIG. 1 shows a perspective view of an amusement ride vehicle 1 for transporting multiple passengers according to the invention. FIG. 2 shows a side view of the same vehicle. The vehicle comprises a movable base 2, a support 3, a lift arm 4, and a carrier 5.

The movable base 2 is adapted to ride over a substructure. In the shown example, the movable base is provided at three locations with pivot wheels 8 for movably supporting the vehicle. The substructure is a support surface 6, preferably part of a track, provided with a rail 7 for guiding the vehicle and for providing the vehicle with electrical power.

In an alternative embodiment, the substructure is for example a rail track, and the base is provided with wheels for engaging the rails. In another alternative embodiment the substructure is a support surface without any guide rail, and is the movable base provided with a drive and a steering device for moving the vehicle over the support surface and along a trajectory.

The support 3 is mounted on the movable base 2. In the preferred embodiment shown, the support is mounted rotatably on the movable base for rotating about a vertical axis 9 to enhance the excitement of the passengers. An actuator for rotating the support is provided, which preferably is dimensioned such that it is capable to rotate the carrier about the vertical axis over an angle of at least 40 degrees per second, preferably over an angle of about 48 degrees in a second. Furthermore, the carrier can preferably be rotated about the vertical axis with an acceleration of at least 25 degrees per second squared, preferably of 30 degrees a second squared.

In the preferred embodiment shown, the carrier can be rotated over a full 360 degrees. Thus the passengers can be transported facing forward, i.e. in the direction of movement of the vehicle, backwards, i.e. facing the direction the vehicle came from, sideways, or any intermediate direction. In an alternative embodiment, the carrier can be rotated over an angle of less than 360 degrees, for example an angle of 180 degrees, divided in an angle of 90 degrees leftward and 90 degrees rightward relative to the direction of movement of the vehicle.

In an alternative embodiment the position of the support is fixed with respect to the movable base. In such an embodiment the carrier is preferably provided with a steering device such that the vehicle can be pivoted about a vertical axis by movement of the base relative to the substructure. For example, when the movable base is supported on a support surface via wheels, the base, and thus the carrier, can be rotated about a vertical axis by driving the wheels on the left side of the base in a forward direction and the wheels on the right side of the base in a backward direction.

In the preferred embodiment shown, the support is a support arm, i.e. the support is an elongated body, which extends along a longitudinal axis. This configuration allows for a compact and light base. The support arm is mounted on the movable base at an angle relative to a vertical axis 9.

The lift arm 4 is pivotably connected to the support for pivoting relative to the support about a horizontal axis 10.

A first actuator 13 is provided for pivoting the lift arm 4 relative to the support 4. Thus, the carrier can be lowered and lifted relative to the movable base while the movable base rides over the substructure.

In the preferred embodiment shown, the first actuator 13 is connected with one end to the support 3 and with its opposite end to an end of the lift arm 4. The lift arm is thus at one end connected to the actuator and at its opposite end to the carrier 5. These two ends of the lift arm 4 are located on opposite sides of the pivot axis of the lift arm.

Figure 6:
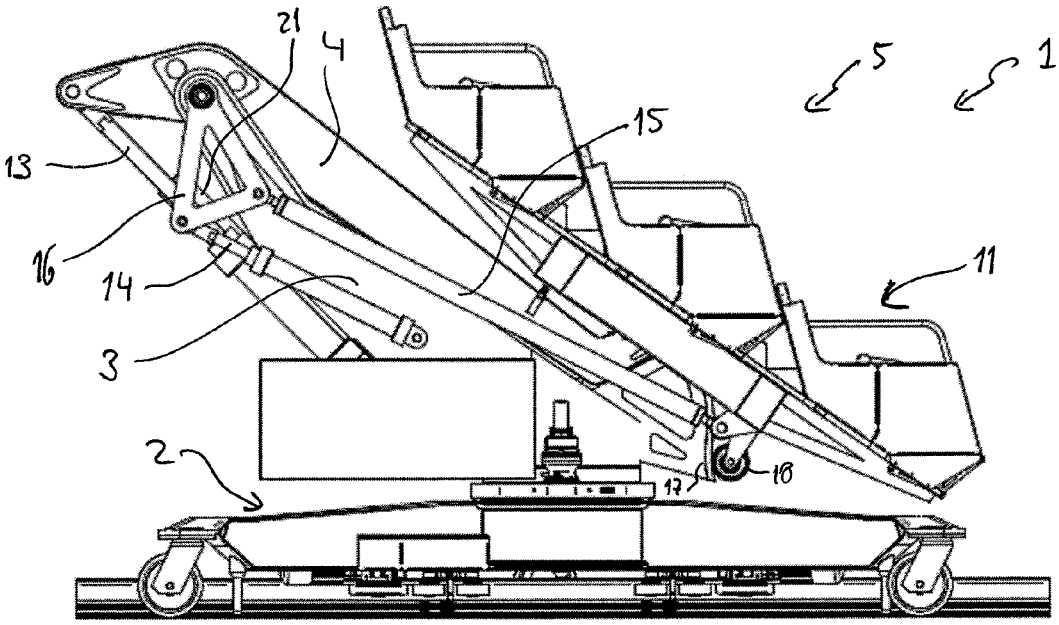
FIG. 6 schematically shows a side view of the vehicle from FIG. 1 with the carrier in a lowered and neutral position.

Therefore, when the carrier is in its lowest position, shown in FIG. 6, the lift arm is located on one side of the support and the actuator for actuating the lift arm on the opposite side of the support. The lift arm can thus be located close to the support. This allows for a compact and stable configuration of the vehicle when the carrier is in its lowered position.

Furthermore, the part of the lift arm extending between the carrier and the pivot axis is substantially longer than the part of the lift arm extending between the actuator and the pivot axis. Thus the lift arm functions as a lever which increases the movement and speed generated by the actuator. Therefore the carrier can be moved over an extended distance and at an increased speed compared to a carrier directly supported by an actuator.

In the preferred embodiment shown in FIG. 1 the first actuator, i.e. for lifting the carrier, comprises two parallel mounted hydraulic cylinders mounted in between the support and the lift arm. In an alternative embodiment, the actuator comprises for example a single cylinder, or a drive, for example an electro motor or other suitable alternative for pivoting the lift arm relative to the base. In a further alternative, the actuator comprises one or more pneumatic cylinders or one or more electric cylinders. An electric cylinder is an electric drive comprising a screw spindle, for example a screw roller bearing spindle, and an electric drive, for moving the spindle in an axial direction.

In the embodiment shown, the lift arm is lifted when the cylinders contracts. In an alternative embodiment, the cylinder or cylinders can be provided on the opposite side of the support, such that the lift arm is lifted when the cylinders are extended. Also, cylinders can be provided on one or more sides of the support.

Figure 9:
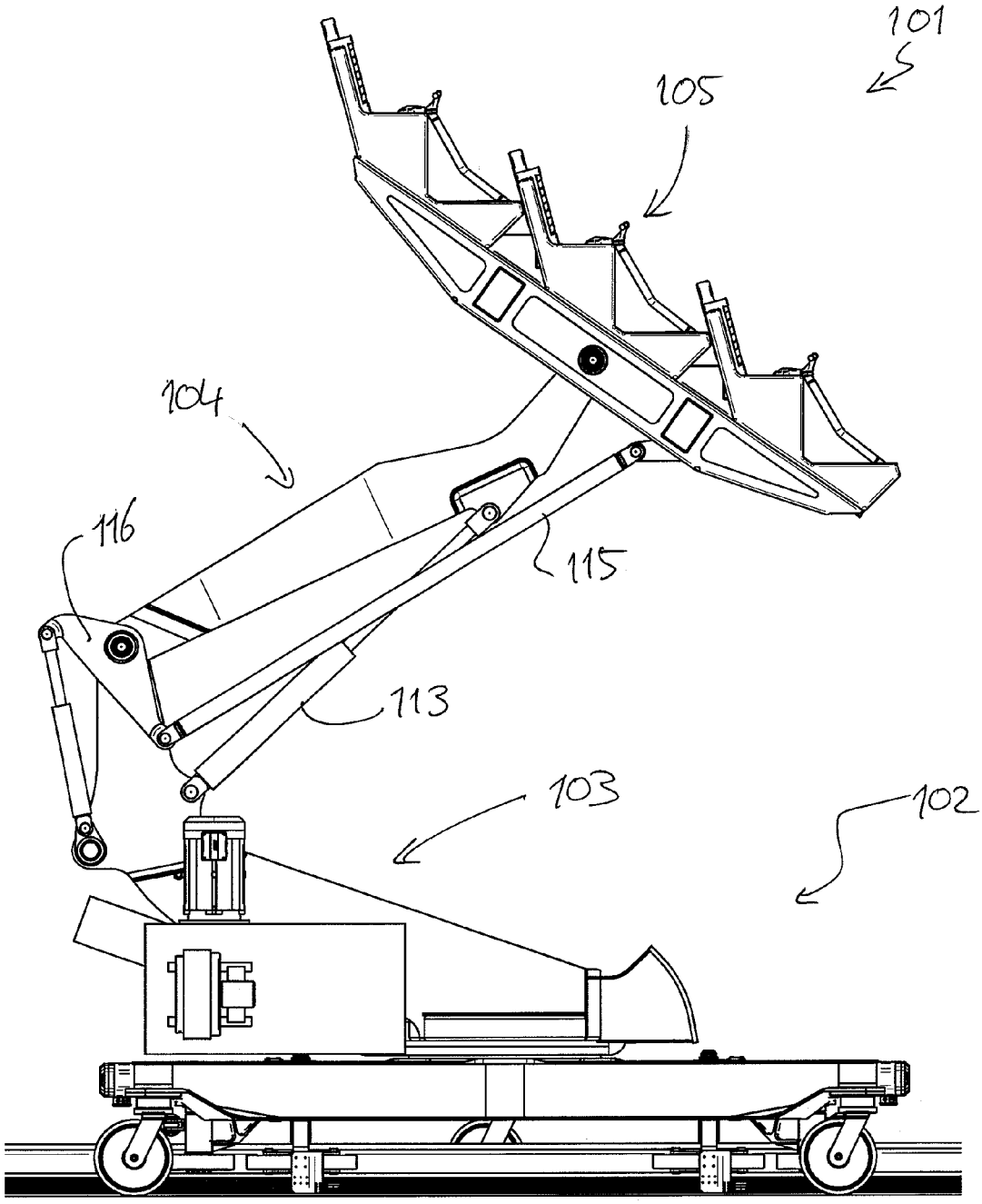
FIG. 9 schematically shows a side view of an alternative vehicle according to the invention.

FIG. 9 shows an alternative embodiment of a vehicle 101 according to the invention, which comprises a movable base 102, a support 103, a lift arm 104, and a carrier 105. In this embodiment, the first actuator, comprising a cylinder for lifting the carrier, is connected with one end to the support 103 and with its opposite end to the lift arm 104. In this embodiment the actuator is located such that the carrier is lifted when the cylinder is extended.

Figure 5:
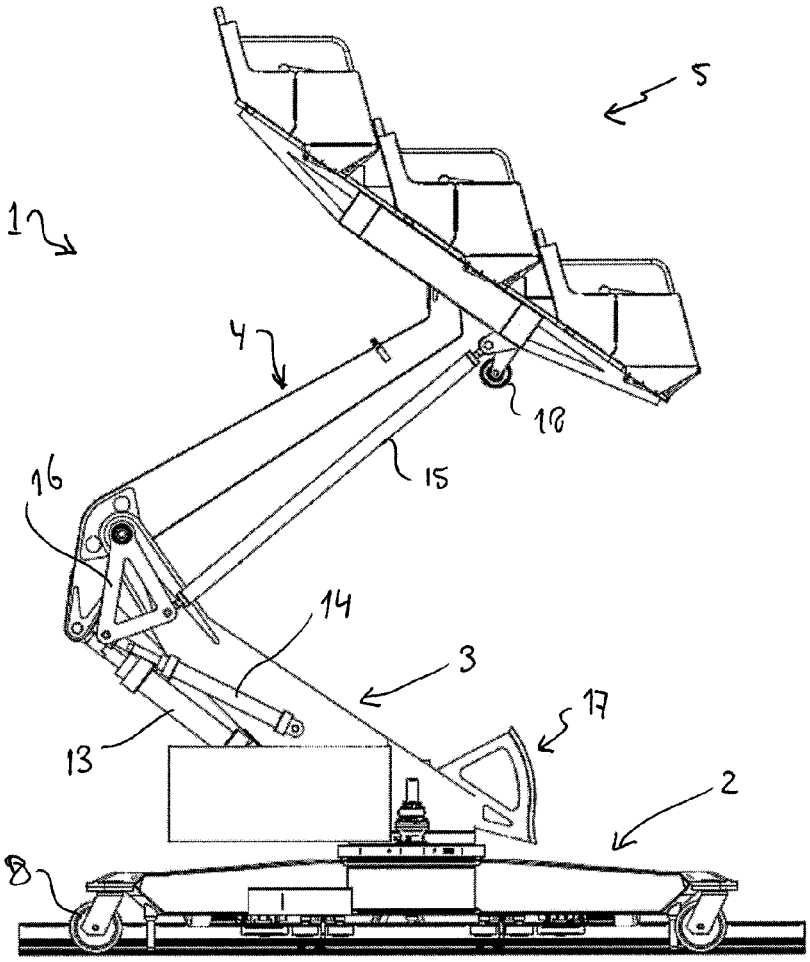
FIG. 5 schematically shows a side view of the vehicle from FIG. 1 with the carrier in a fully lifted and neutral position.

FIG. 5 shows the lift arm of the exemplary embodiment in its highest position and FIG. 6 shows the lift arm of the exemplary embodiment in its lowest position. Preferably the vehicle is dimensioned such that the carrier can be lifted and lowered over a distance of at least 3 meter, preferably over a distance of about 3.5 meter. Furthermore, to enhance the excitement of the passengers, the vehicle and actuator are preferably dimensioned such the carrier can be lifted with a speed of 2 meters a second and with an acceleration of 2 meter per second square. Preferably, the actuator is able lift the carrier from it lowest position up to the 3.5 meters within 3 seconds, preferably in 2.8 seconds.

The carrier 5 is pivotably supported by the lift arm 4 for pivoting relative to the lift arm about a horizontal axis. A second actuator 14 is provided for pivoting the carrier 5 relative to the support 4, and thus for adjusting the pitch of the carrier, while the movable base rides over the substructure. The horizontal axis extends essentially parallel to the back supports of the seats provided on the carrier, such that by pivoting the carrier about the horizontal axis, the seats are pitched in a forward or in a backward direction respectively.

The pivot axis connecting the lift arm to the carrier is preferably located at or near the centre of the carrier, when seen in side view (as shown in for example FIGS. 2 and 9), such that when the carrier is pivoted one end of the carrier moves in a direction opposite to the direction of movement of the opposite end of the carrier. When pitching the carrier one end moves in an upward direction while the opposite end moves in a downward direction. Thus, the force needed for pitching the carrier is limited. In the preferred embodiment shown, the centre of gravity of the carrier is located near the pivot axis connecting the carrier to the lift arm. Thus, the force for pivoting the carrier is furthermore limited.

In an alternative embodiment, the pivot axis connecting the lift arm to the carrier is located near the lower or upper end of the carrier, such that all seats move in the same direction when the carrier is pivoted.

In a further embodiment, in addition to the horizontal pivot axis the carrier may be connected to the lift arm via a vertical pivot axis also, such that the carrier can be pivoted in a leftward direction and a rightward direction relative to the lift arm.

Figure 11:
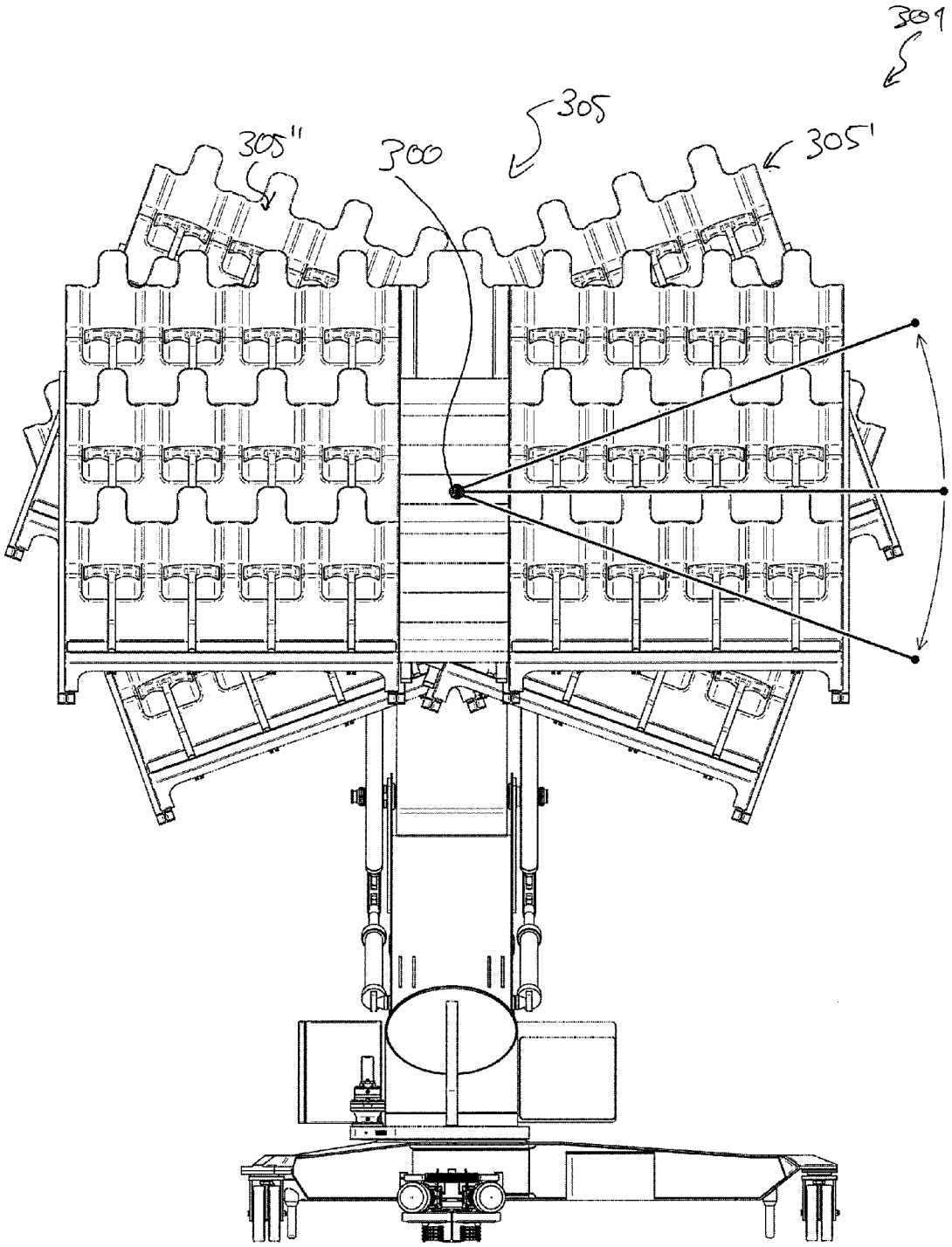
FIG. 11 schematically shows a front view of a further alternative vehicle according to the invention.

In a further embodiment, shown in FIG. 11, the carrier is mounted such that it can pivot sideways, or left to right, about a centre point. FIG. 11 shows such a vehicle 301, of which the carrier 305 can be pivoted about an axis 300. In the position of the carrier shown, the axis 300 extends perpendicular to the plane of the fig. The carrier is shown in 3 positions, a central position 305, a first sideways pivoted position 305' and an opposite sideways pivoted position 305". Thus, the carrier can, for example when moving about a corner, be pivoted sideways to provide the passengers with the experience of taking a corner at high speed.

A carrier according to a preferred embodiment of the invention is provided with multiple seats for supporting passengers. It is observed that seats in the context of this text should be interpreted as an example of a structure for supporting passengers. In a preferred embodiment, the passengers are supported by a seat shaped support comprising a seat and back support for supporting the passenger in a straight up seated position or in a seated reclining position. In an alternative embodiment, the carrier is provided with passengers support structures for supporting the passengers in a standing position or for example in a motor racing position i.e. lying down face forward. Alternative passenger support structures are known from the art, for example from WO2007136245 and WO 2009022905, and are therefore not elaborated upon here.

The carrier in a preferred embodiment has a neutral position in which the passengers can enter and leave the seats, and the carrier can be pivoted relative to that neutral position between a pitched forward position, in which the seats are tilted forward, and a pitched backward position in which the seats are tilted backward, to enhance the sense of excitement of the passengers.

Figure 3:
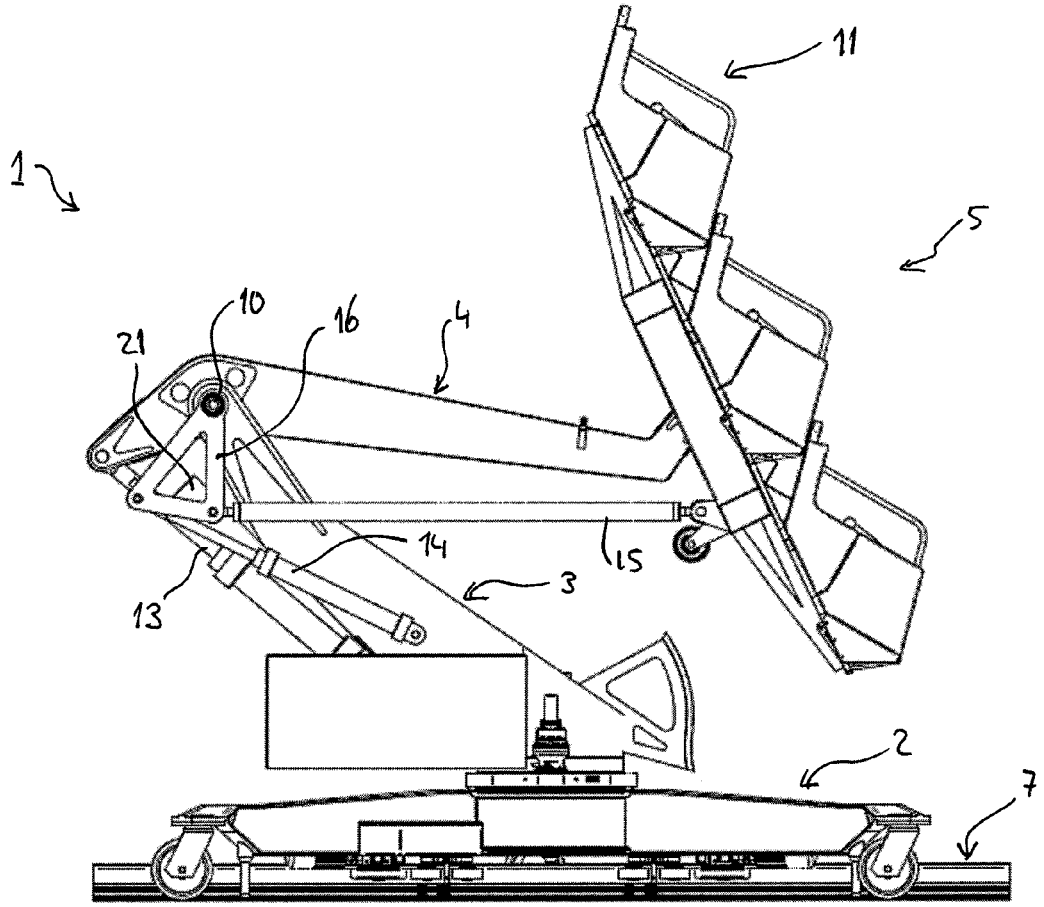
FIG. 3 schematically shows a side view of the vehicle from FIG. 1 with the carrier in a lifted position and pitched forward.
Figure 4:
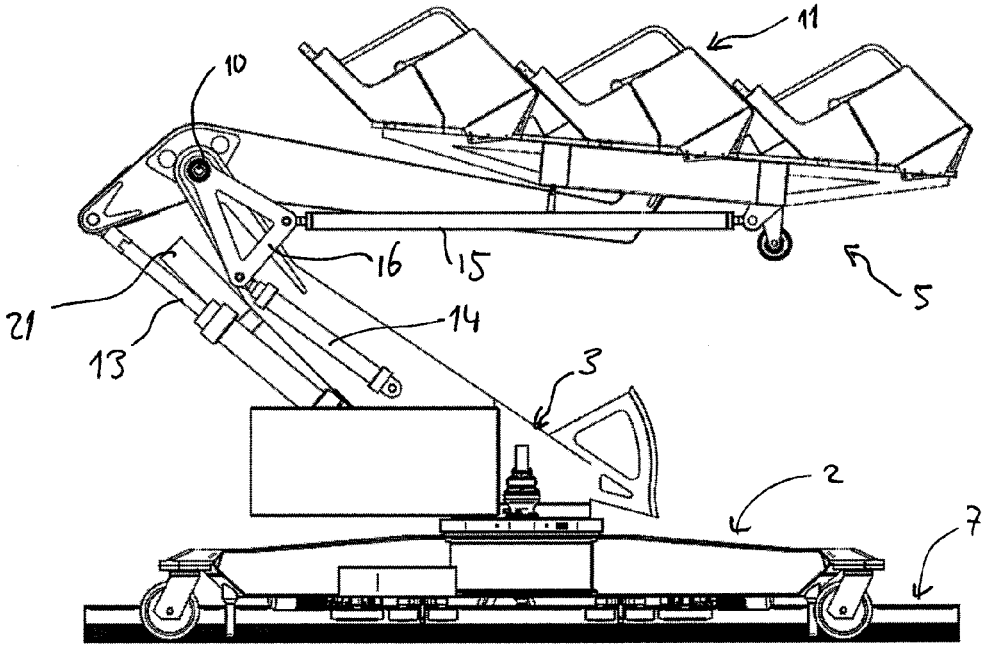
FIG. 4 schematically shows a side view of the vehicle from FIG. 1 with the carrier in a lifted position and pitched backward.

To enhance the excitement of the passengers, the vehicle and actuator are preferably dimensioned such the seats, when seen in side view in the pitched forward position (shown in FIG. 3) are at an angle of 25 degrees or more, preferably of 30 degrees or more, relative to the seats when in the neutral position (shown in FIG. 2), and/or the seats, when seen in side view, in the backward position (shown in FIG. 4) are at an angle of 30 degrees or more, preferably of 35 degrees or more relative to the seats when in the neutral position.

In the embodiment shown the seats provided primarily provide back support to the passengers. Thus, to provide the passengers with a comfortable ride, a pitched backward position is preferred, and the pitched forward position of the seats is preferably limited to for example 15 or 20 degrees relative to the seats in the neutral position.

Figure 10:
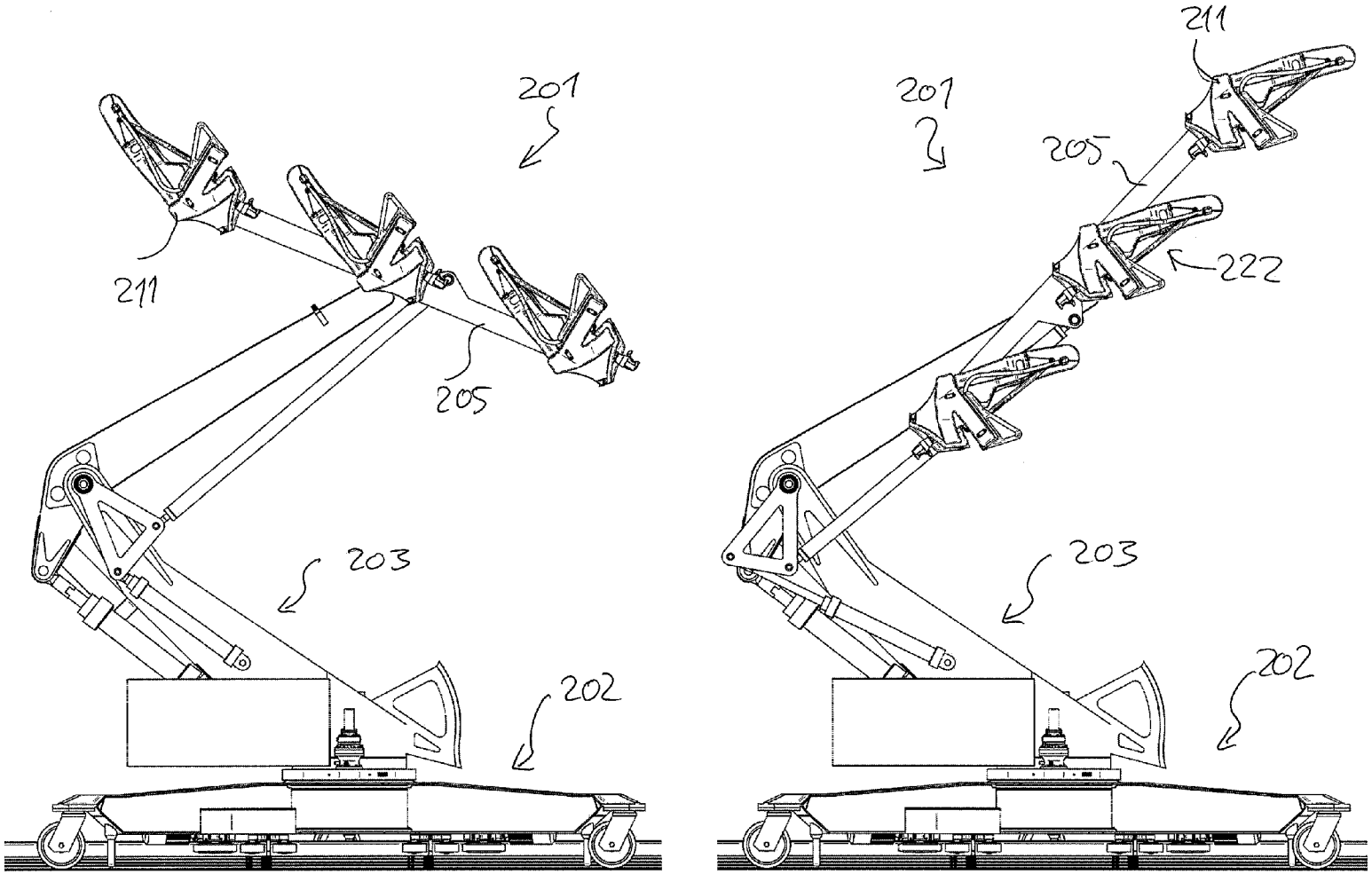
FIG. 10 schematically shows tow side views of a further alternative vehicle according to the invention.

In an alternative embodiment, shown in FIG. 10, the carrier 205 is provided with seats 211 which provide more support to the passenger when in the pitched forward position, for example in the preferred embodiment shown because the seats are provided with a harness or restraining device 222 which provides chest support to the passenger when the carrier is in the pitched forward position. In such an embodiment passengers are comfortably supported in a pitched forward position at an angle of for example 30 degrees or more relative to the seats in the neutral position.

Also, to enhance the excitement of the passengers, the vehicle and actuator are preferably dimensioned such the seats can be pitched with a speed of at least 25 degrees per second, preferably of about 30 degrees a second, and/or with an acceleration of at least 25 degrees a second, preferably of about 30 degrees a second. Preferably, the carrier can be fully tilted in about 3 seconds.

The carrier supports multiple passenger seats 11. FIG. 1 shows that the seats are distributed in 3 successive rows of 8 seats. In the preferred embodiment shown, the carrier comprises a stand with seats located at different heights relative to the movable base when the carrier is in the neutral position. Thus the passengers all have an optimal field of vision which is not substantially blocked by a person sitting in front of them.

The stand shown is furthermore provided with a central stairway which provides access to the rows of seats. In the configuration shown, the passengers enter the carrier at its bottom row. Other amounts and configurations of seats are possible. For example, the carrier, more in particular the stand, can be designed for the passengers to enter the carrier and the rows of seats via stairways located at the side of the carrier, or via a central stairway starting at the top row. Also, a combination of these is possible. In a further embodiment, the passengers for example enter the carrier from the left side or at its bottom end, and exit the carrier at its right side or at its top end. In a further embodiment, the passengers enter the rows of seats via ramps or stairways which are part of a boarding station.

The carrier 5 is furthermore provided with a restraining device 12 adapted to restrain each individual passenger in a seat. In the embodiment shown, the restraining device comprises one clamping bar per seat. Each clamping bar is T-shaped, and is hingeably connected to the carrier beneath the floor plane in front of the seat, such that the "leg" of the bar is located in-between the legs of a seating passenger when restraining the person in the seating position. The clamping device is preferably activated with a hydraulic system provided on the vehicle.

Alternative restraining devices for securing passengers in their seat are known from the art and suitable for securing a passenger in the seat of an amusement vehicle can also be used. For example, a U-shaped clamping bar per seat, of which the "legs" of the clamping bar extend along the outside of the legs of a passenger sitting in the chair, or a U-shaped clamping bar per seat of which the "legs" of the clamping bar extend over the shoulders of a passenger sitting in the chair. Also a restraining device may comprise clamping bars which clamp multiple persons, etc.

In the preferred embodiment shown, the vehicle is further provided with a pitch adjustment boom, which extends along the lift arm and which is at one end pivotably connected to the carrier. The pitch adjustment boom is movable along the longitudinal axis of the lift arm for adjusting the pitch of the carrier. In the particular embodiment shown, the pitch adjustment boom is connected to the carrier at a point below the pivot axis of the carrier, i.e. below the point at which the carrier is connected to the lift arm. When the pitch adjustment boom is moved in a direction towards the carrier, the carrier is pitched in a backward direction, and when the pitch adjustment boom is moved in a direction away from the carrier, the carrier is pitched in a forward direction.

Because a boom is used, the actuator for moving the pitch adjustment boom, and thus for pitching the carrier, can be located at a distance from the carrier. Thus the actuator, which is relatively heavy compared to a boom, is not lifted over the same distance as the carrier and the force needed for lifting the carrier is limited. Also, the wiring and or tubing for providing power to the actuator does not need to be extended along the full length of the lift arm.

In a preferred embodiment, the actuator for pivoting the carrier is located on the base or, as is shown in the figs., on the support. In these configurations the actuator for pivoting the carrier is not lifted or lowered when the carrier is lifted or lowered. Thus, the lift arm and the actuator do not need to be dimensioned for supporting or lifting the weight of the actuator in addition to the weight of the carrier.

In an alternative embodiment, the actuator is for example a drive located at the end of the lift arm and engaging the carrier. In a further embodiment, in stead of the pitch adjustment boom a hydraulic, pneumatic or electric cylinder is provided which is with one end connected to the carrier and with its opposite end to the lift arm or to the support or carrier.

In the preferred embodiment shown, the pitch adjustment boom 15 is with its first end pivotably connected to the carrier and with its second end pivotably connected to a linkage member 16. The linkage member 16 is pivotably connected to the pitch adjustment boom 15, to the hydraulic cylinder 14, and to the pivot axis connecting the lift arm to the support.

The movement generated by the hydraulic cylinder for pitching the carrier, is transferred via the linkage member 16 to the pitch adjustment boom 15 to the carrier 5. When the hydraulic cylinder 14 extends, the linkage member is moved in a clockwise direction relative to the pivot axis 10. The pitch adjustment boom is moved in a direction away from the carrier, pitching the carrier in a forward direction. For pitching the carrier in a backward direction, the hydraulic cylinder 14 is contracted, the linkage member 16 is moved in a counter clockwise direction relative to the pivot axis 10, and the pitch adjustment boom is moved in a direction towards the carrier.

In the preferred embodiment shown, the vehicle 1 thus comprises carrier pivot drive comprising a pivot boom 15, a linkage member 16 and an actuator 14. Furthermore, in the preferred embodiment shown a first carrier pivot drive is provided on one side of the base and lift arm, and a second carrier pivot drive the opposite side of the base and lift arm.

The carrier pivot boom 15 is pivotably connected to the carrier 5 with a first end and with its second end to the linkage member 16, which is pivotably connected to the base 2. The actuator 14 for pivoting the carrier comprises two hydraulic cylinders, which are arranged between the base and the linkage member. This allows for a geometrical optimal design of the carrier pivot drive, in particular in view of the dimensions of the apparatus which has its effect on the movability of the apparatus. In particular, by locating the actuators on the base the point of gravity of the vehicle is kept close to the substructure, even when the carrier is in its raised position, which improves the stability of the vehicle.

It is noted that in an alternative embodiment, the pivot boom, linkage member and/or actuators can be positioned on opposite sides of the lift arm and/or the support. The actuators for pivoting the lift arm can for example also be located on the side(s) of the support. An alternative configuration of the linkage member, and cylinders is shown in FIG. 9.

In the exemplary embodiments shown in FIGS. 2 and 9, as is preferred, the vehicle thus comprises a kinematic linkage assembly arranged between the support 3; 103 and the carrier 5; 105. The linkage assembly comprises the linkage member 16; 116, the lift arm 4; 104, the carrier 5; 105 and the pivot boom 15; 115.

When the linkage member is pivoted by the actuator, the pivot boom is moved, and the carrier "follows", i.e. is pivoted relative to the base. When the lift arm is raised or lowered and the linkage member is held in position, the pivot boom keeps the carrier at a constant pitch, for example in the neutral position, relative to the base.

Thus, there is no need of actively adjusting the pitch of the carrier to account for the changing pitch of the lift arm while lifting or lowering the carrier. Due to the kinematic assembly, i.e. connecting the pivot boom via the linkage member to the actuator, the control of the pitch of the carrier is simplified.

Furthermore, due to the kinematic linkage assembly the actuators for pivoting the carrier can be located on the base of the vehicle.

In the embodiment shown in FIG. 1, the passengers can embark and disembark when the carrier is for example in its lowest position. To allow the passengers to enter and leave the carrier via the central stairway of the carrier, it is positioned in its neutral position. The control unit for controlling the actuators is preferably designed such that it automatically positions the carrier with the seats in the neutral position when the carrier is moved into its lowest position for allowing the passengers to board and/or disembark the carrier.

When the passengers board and disembark the carrier in it's fully lowered position, the station does not need elaborate ramps or structures for providing the passengers with access to the carrier.

In an alternative embodiment, the station is designed for allowing the passengers to board and disembark the carrier when in the fully lifted, or in an intermediate position. For example, the station can be provided with a room for boarding and/or disembarking, which room is located above the tracks and is provided with openings in the floor for receiving the carriers form below. The vehicle is located beneath an opening in the floor, and subsequently the carrier is lifted through the opening into the room for boarding and disembarking. Preferably, the carrier and the station are designed such that the carrier appears to be part of the station when located in the room. An advantage of such a configuration is that when the carrier is in the room, the track and the vehicle itself are hidden from view. Furthermore, the lowering and lifting of the carrier out of and into the room provides the passengers on the carrier with an extra thrill.

In the embodiment shown, the vehicle is provided with a device for mechanically forcing the carrier into its neutral position when the carrier is lowered into its lowest position. The support is provided with a guide surface 17, more particular a cam track. The carrier is provided with a cam 18, in the particular embodiment shown a wheel, for cooperating with the guide surface. When the carrier is lowered while pitched forward, the wheel 18 engages the guide surface 17, which forces the carrier from the pitched forward position into the neutral position.

In the embodiment shown, the carrier, when in the lowest position, is prevented from pivoting in the backward direction by the lift arm, which is located adjacent the carrier. Furthermore, when the carrier is lowered while pitched backward, it engages a stop 19, located on the lift arm, which forces the carrier from the pitched backward position into the neutral position.

A guide surface and a stop are preferably provided when hydraulic or pneumatic actuators are used for pivoting the carrier. When the lift arm is moved into its lowest position without activating these actuators for pivoting the carrier into its neutral position, the carrier is pivoted automatically into its neutral position by the guide surface and the cam. However, preferably, the carrier when lowered into its lowest position is pivoted by the actuator in the correct position, and the cam track and/or the stop are not touched by the carrier.

In the preferred embodiment shown, the guide surface 17 and the stop 19 are located on the support, which is movably supported by the base. Thus, the guide surface and the stop "follow" the carrier when it is rotated about the vertical axis. The guide surface and the stop are thus always correctly positioned.

In an alternative embodiment, for example when the support is not rotatably mounted, the stop and/or guide surface are located on the base.

In an alternative embodiment, the carrier is designed to allow pitching in the forward direction and/or in the backward direction when in the lowest position. For example, in the embodiment shown the carrier can be provided with an opening for receiving the lift arm and the support. Thus, the carrier can be pivoted in a backward direction without colliding with the lift arm and the support.

Figure 8:
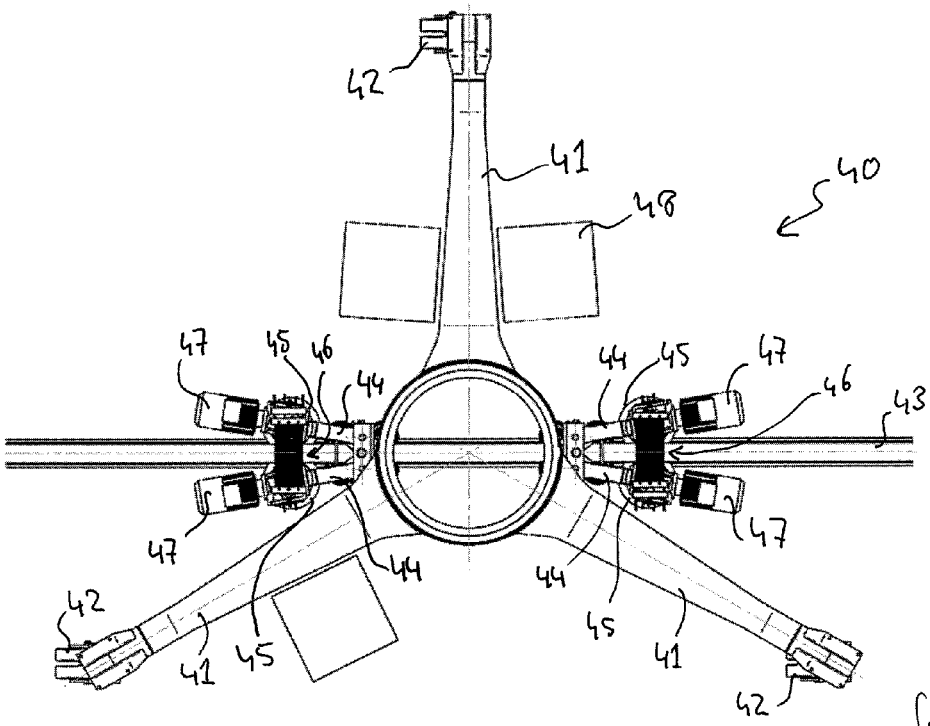
FIG. 8 schematically shows a top view of an exemplary embodiment of a movable base according to the invention.

FIG. 8 shows a top view of a preferred embodiment of a movable base 40 of a vehicle according to the invention, similar to the movable base 2 shown in FIGS. 1-6. The basis 40 is provided with three radially extending arms 41 which are at their end provided with swivel wheels 42 for supporting the movable base on a substructure. This configuration provides a stable support. Also, the three arms in combination with the swivel wheels allow for easy pulling the base along a track, without the need of a steering device.

The movable base is supported at a certain height above the substructure, such that the centre part of the base can be positioned above a guide rail 43 for guiding the vehicle along a track.

The movable base is provided with a drive device for engaging a guide rail and for pulling the vehicle along said guide rails. The drive device comprise two pairs of pivotable arms 44, wherein each arm is provided with drive wheel 45 for engaging the side of the guide rail 43. A spring 46 is provided to pull the two arms towards each other and thus clamp the wheels against the rail. The drive device furthermore comprise an electric drive 47 per arm for each driving a drive wheel.

The movable base is furthermore provided with a contact guide wheels 48, smaller than the drive wheels 45, which position the movable base 40 relative to the guide rail 43.

Preferably, the first and second actuator comprise hydraulic or pneumatic cylinders and the vehicle is provided with an electrically powered hydraulic or pneumatic system for activating these cylinders. In the embodiment shown a hydraulic system 48 is fixed to an arm of the movable vehicle.

The hydraulic system of the vehicle is furthermore provided with a cylindrical shaped accumulator 21, located in between the cylinders of the first actuator, which allows for the accumulation of hydraulic energy. The energy is generated by a pump, which pump can also be used for providing the hydraulic cylinders with hydraulic pressure. When needed, the pressure saved in the accumulator can be used in addition to or instead of the pressure provided by the pump for extending the cylinders. Thus, the hydraulic cylinders can be extend more quickly, and/or extended when the pump is inactive. It is noted that an accumulator can also be used with a pneumatic system.

In an alternative embodiment the first and second actuator comprise electric cylinders and the vehicle is provided with electric power, for example via a guide rail, batteries or fuel cell, for driving these cylinders.

In a further preferred embodiment, the support is rotatable mounted on the base and rotated by way of a hydraulic or pneumatic actuator, preferably part of an electrically powered hydraulic or pneumatic system.

In a preferred embodiment the movable base is provided with an electric contact for engaging an electrical track to provide the base with electrical power, for the drive of the vehicle, the control system of the vehicle and/or the actuators for moving the carrier and the clamp system.

The vehicle is preferably provided with a drive for driving the vehicle over the substructure along a track throughout an amusement attraction. The drive is preferably an electric drive which drives the wheels of the vehicle or which engages a guide rail or guide surface to drive the movable base along said guide rail or guide surface. Alternatively, the drive for driving the vehicle along the track is for example a hydraulic drive or a pneumatic drive.

By providing a guide rail to guide the vehicle, there is no need to provide the vehicle with an elaborate steering system.

Preferably the vehicle is controlled by a control unit which controls the movement of the vehicle, for example along a predetermined track in an amusement ride. Thus there is no need for a human driver to continuously control the movement of the vehicle. Automated control of vehicle is preferred for most amusement rides, in particular in amusement rides with a closed loop track. In addition to or in stead of such a control unit, the vehicle is preferably provided with a control panel for control of the control unit and/or the actuators by a person, which control panel overrules the optionally automated control of the vehicle. In the embodiment shown a control unit and a control panel are provided in a box 49 attached to an arm of the movable base.

In an alternative embodiment, a driver controls the movement of the vehicle and/or the carrier. The driver can be located on the vehicle or control the vehicle from a distance, for example from a control room. Also a combination of automated and driver control is possible. For example, the track can be provided with cross roads at which the passengers can indicated the control system controlling the movement of the vehicle that they want the vehicle to go left or right.

Preferably, a control unit for controlling the actuators and the movement of the vehicle is provided for each vehicle and mounted on each vehicle. In an alternative embodiment the vehicle is partly of totally controlled by a control unit which is stationary based, and for example is part of the amusement ride. For example, the amusement ride can be provided with a central control room comprising one or more control units for each controlling one or more vehicles. In such a configuration the vehicles are provided with receivers for receiving control signals from the control units, for example electrical signals or radio wave signals.

In a further embodiment, part of the control is centralised and part of the control is provided via a control unit on the vehicle. For example, the control of the movement of the vehicles along the track is controlled by one central control unit, while the movement of the carrier is controlled by a control unit localised on the vehicle.

The exemplary embodiments shown are guided along a guide track or rail. In an alternative embodiment the vehicle is provided with a drive and steering system, preferably provided with a control system which steers the vehicle using GPS signals, indicators in the support surface or way points. Thus the vehicle can be guided along a track without the need of a guide track. Also, this system allows for flexible track lay out, and for providing different vehicles with different tracks, etc.

The vehicles may be provided with semi automatic control, which for example controls the distance between the vehicle and a vehicle in front of it, or which moves the vehicle to a parking track when the control system is signalled by an operator that maintenance is due. Systems for (semi) autonomous control of vehicles are known in the art and are therefore not elaborated upon.

In a further alternative embodiment, the ride is provided with transport systems such as conveyors for engaging the vehicle and/or engagement by the vehicle, to move the vehicle along the track. In a further alternative embodiment multiple vehicles are linked via a chain or wire system to form a train of vehicles which are all moved along the track by one or more drives pulling the chain along the track. Systems for movement of vehicles are also known in the art and are therefore not elaborated upon.

In a vehicle according to the invention the movement of the carrier can be linked to the movement and/or position of the vehicle and/or to the scenery of the ride and/or to an action of one or more of the passengers. Preferably the vehicle comprises a computer control unit for controlling the first and second actuator, and preferably the drive of the vehicle and/or the angle of rotation of the support, preferably in dependence of at least one variable such as the location of the vehicle, the distance traveled by the vehicle, or the time lapsed since start of the ride.

The control may be provided with a program which stores the movements of the vehicle and/or carrier in relation to for example the position of the vehicle in the ride, or the distance traveled along a track of the ride.

In a further embodiment, the control unit may be provided with sensors which provide the control unit with ambient information, for example the position of the carrier with respect to a scenery element of the attraction, or which are capable to receive signals from remote controls activated by actors performing in the scenery of the amusement ride, which information the control unit uses to control the movement of the vehicle and/or carrier. Also, the sensors may provide the control unit with input from the passengers. For example a camera may be provided to interpret signals by the passengers, e.g. waving with the arms or pointing in a direction.

The carrier is preferably positioned to guide the attention of the passengers to aspects of the scenery of the ride. For example, in the pitched backward position the passengers can observe high positioned scenery, and are thus for example presented a depiction of birds flying through the sky. In the pitched forward position, the passengers can look in a downward direction, for example at a depiction of an abyss.

Furthermore, the movement of the carrier is preferably used to increase the thrill of the ride. For example, lifting and lowering of the carrier can induce the feeling of flying or falling, and movement of the carrier, by movement of the vehicle or by pivoting the carrier about a vertical axis, in a pitched forward position induces the feeling of hovering over a landscape. By quickly lowering the carrier and tilting it backwards while moving into a tunnel or below the overhanging branch of a tree, the passengers are provided with the experience of sliding feet forward into the tunnel or diving under the branch. Also the speed of the adjustment of the carrier, and the acceleration and deceleration can be used to provide thrills for the passengers.

The invention furthermore provides an amusement ride comprising a track, e.g. a road or rail track, preferably a closed loop track, and at least two vehicles for movement along a track.

Each vehicle comprises a movable base adapted to ride along the track, a carrier for supporting multiple passengers, and a restraining device adapted to restrain each individual passenger in a seat. The carrier is preferably configured as a stand supporting multiple passenger seats.

The vehicles furthermore comprise a motion apparatus, which is able of to rotate the carrier relative the movable base about a vertical axis. In a further embodiment, the motion apparatus supports the carrier and is able to lift, pivot and rotate the carrier relative to the movable base during the ride to enhance the experience of the passengers. In a preferred embodiment, the motion apparatus comprises a support, a lift arm and a carrier as shown in FIG. 1. Preferably, the vehicle is a vehicle as shown in FIG. 1.

The motion apparatus can rotate the stand such that it is turned towards another vehicle and the passengers sitting in the seats face the passengers sitting in the other vehicle and visa versa, to enhance the experience of the passengers.

Preferably, the motion apparatus can pivot the stand relative to a neutral position, in which the seats are in an upright position, into a pitched forward position, in which the seats are tilted forward, and into a pitched backward position, in which the seats are tilted backward to further enhance the experience of the passengers.

Figure 7:
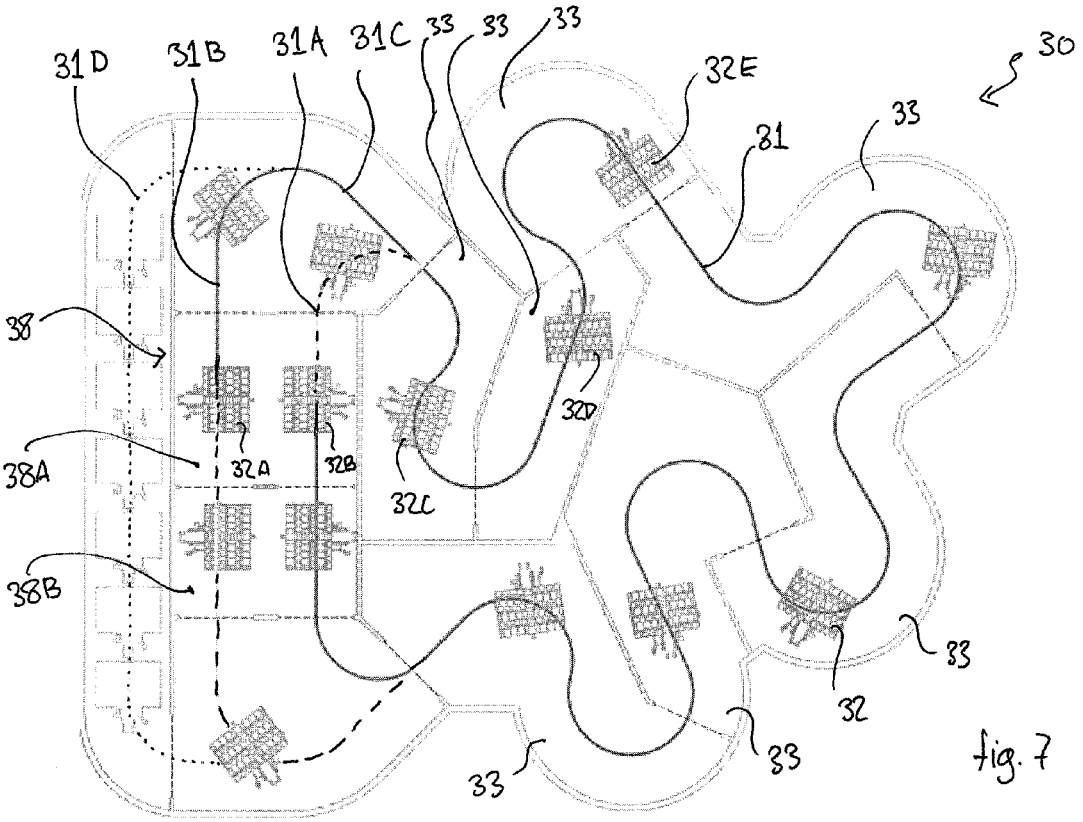
FIG. 7 schematically shows a top view of an exemplary embodiment of a ride according to the invention.

FIG. 7 shows a schematic top view of an amusement ride 30 according to the invention. The ride comprises multiple passenger vehicle carriers 32 according to the invention, and a track 31 for guiding said passenger vehicle carriers. In the embodiment shown, the track is defined by a guide rail, for guiding a movable base, for example one as shown in FIG. 8, of a vehicle along the ride.

The vehicles drive along the track 31 in a clockwise direction. The track is a closed loop track, i.e. the vehicles can endlessly follow the track. In the preferred embodiment shown, the track 31 comprises an inner track 31 A, an outer track 31 B and a single track 31 C. Furthermore, a service track 31 D is provided, on which vehicles can be parked for example to be serviced.

In FIG. 7 the vehicles 32 are schematically shown in top-view. It is observed that the carriers during a ride are lifted, lowered, pitched forward, backward, etc. to enhance the experience of the passengers. This aspect is not shown in this figure, in which the carrier of each vehicle is shown in the lowest, neutral position.

FIG. 7 does show carriers with the carriers rotated about a vertical axis. For example, the carriers of the vehicles 32 A and 32 B in the station are rotated perpendicular to the track, such that the passengers of the respective vehicles face each other. Furthermore, the carrier of the vehicle 32 C faces perpendicular to the direction of movement, the carrier 32 D essentially faces backward relative to the direction of movement, carrier 32 E faces forward relative to the direction of movement, etc. By rotating the carriers about a vertical axis during the ride, the view of the passengers can be directed to specific scenery, other vehicles, etc.

The exemplary ride shown comprises multiple event areas 33 which each comprise a typical scenery or event and together compose the ride. One event area for example stages a city scenery, while the subsequent event area stages an indoor scenery. The layout of the track and the event areas shown is such that the passengers during the ride along the single track do not face a proceeding or preceding passenger vehicle. The event areas may be separated by movable doors, curtains, etc, which open up to let the vehicle pass and which thus heighten the experience of the transition from one event area to the other for the passengers.

Also, a station 38 is provided. The station comprises a boarding area 38A and a disembarking area 38B for boarding and disembarking of the vehicles by the passengers. Preferably, the boarding area and the disembarking area are separated by a curtain such that the boarding and disembarking passengers do not see each other.

Figure 12:
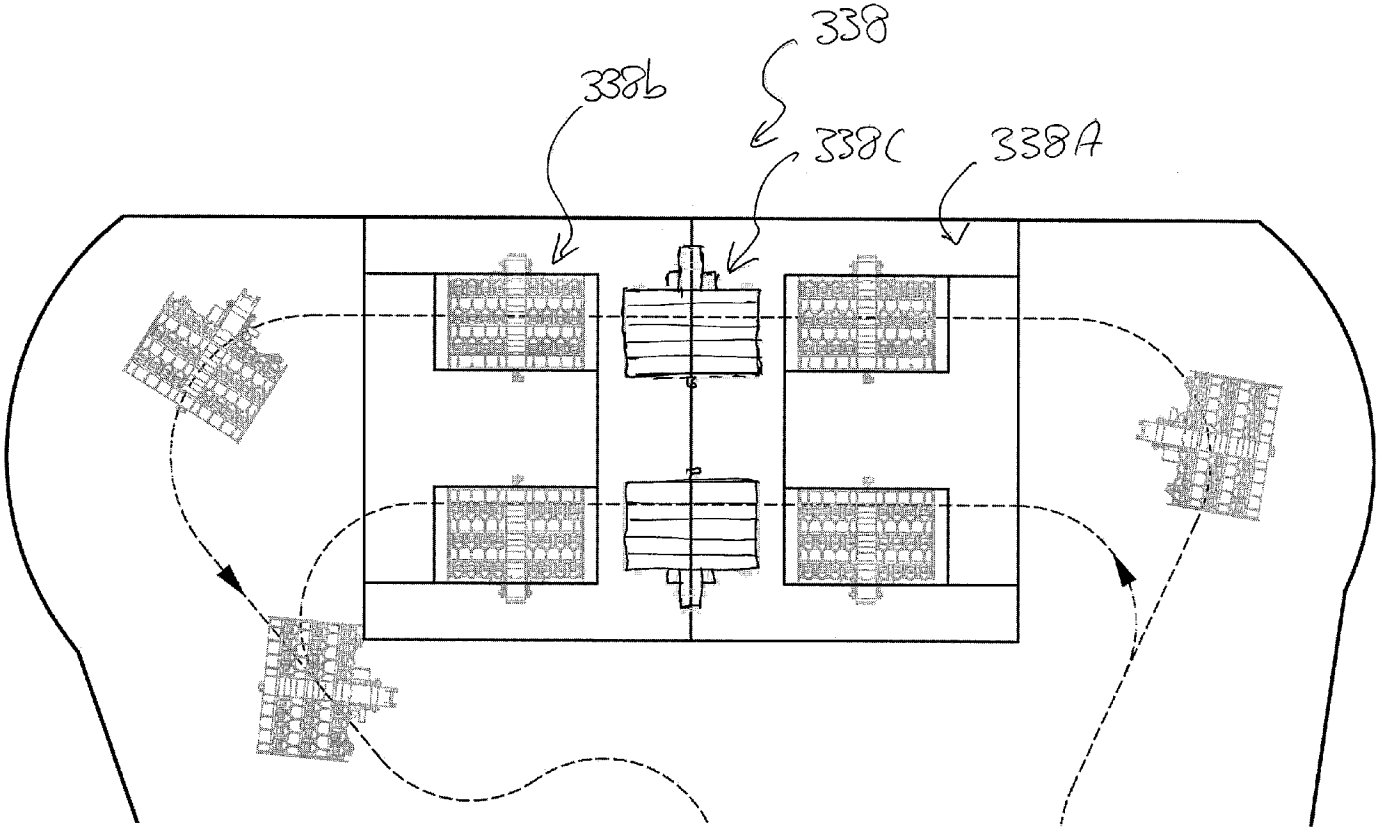
FIG. 12 schematically shows a top view of an exemplary embodiment of an laternative ride according to the invention.

FIG. 12 shows an alternative station 338, provided with a buffer area 338*c*, in between the boarding area 338*a* and the disembarking area 338*b*. After the passengers disembarked, a vehicle is moved into the buffer area. While the vehicle is in the buffer area, the upstream vehicle is loaded with passengers, while a downstream vehicle is unloaded. By moving the vehicle faster or slower through the buffer area, changes in time during loading and unloading can be compensated. For example, when it takes extra time to disembark all passengers, the vehicle in the buffer area can still be moved in time into the embarking area to allow for the passengers to embark and start the ride on schedule. When there is no buffer area, extra time needed for disembarking does immediately result in less time for subsequently embarking the passengers, and thus most probably in the vehicle leaving the station behind schedule.

The inside track 30 A and outside track 30 B are located within the station 38, and allow for two vehicles to ride through the station alongside each other. After leaving the station, the inside track 30 A and outside track 30 B unite into the single track 30 C, on which the vehicles ride one behind the other. The single track splits into the inside track and outside track prior to entering the station.

When the ride is provided with an inside and one ore more outside tracks, a first vehicle riding the inside track can ride next to a second vehicle riding the outside track, in the embodiment shown two vehicles can therefore enter and/or leave the station at the same moment.

In the preferred embodiment shown, the vehicles are provided with a rotatably mounted support on the movable base for rotating the stand about a vertical axis. Thus the carriers, preferably configured as stands, of two vehicles riding next to each other can be rotated towards each other such that the passengers sitting in the seats of the first vehicle face the passengers sitting in the second vehicle.

In the preferred embodiment shown, the station is designed for receiving the vehicles for disembarking and/or boarding, with the stand of a vehicle in the inner track positioned such that the passengers sitting in the seats face the passengers sitting in the vehicle on the outer track and visa versa. In one embodiment, the areas for boarding and disembarking are located above the tracks, and the carriers are lifted into these areas through an opening in the floor of the respective areas, and lowered through said opening prior to continuing the movement along the track.

A station is provided with structure such as ramps or stairways and/or walking tracks lay outs, which provide persons with access to a carrier of a vehicle positioned in the station. In the preferred embodiment shown, the carrier is positioned such that the passengers leave and enter the station facing in a direction perpendicular to the direction of movement of the carrier along the track. Due to the position of the carrier, the passengers are moved sideways when the vehicle is leaving or entering the station. Furthermore, the position of the carriers provides the passengers with a view of the passengers of the other vehicle while starting and ending the ride.

In an alternative embodiment, after boarding the stands of the adjacent vehicles are rotated away form each other, such that the passengers of the respective vehicles no longer face each other, before the vehicles start to move along the track.

In a preferred embodiment, the inside track 31 A and outside track 31 B are configured such that when two vehicles leave the station at the same moment and follow the track 31 with the same speed, they end up one behind the other on the single track 31 C. The inside and outside track are furthermore configured such that when the two vehicles after travelling the single track one behind the other, they enter the station at the same moment.

In the preferred embodiment shown, the outer track is longer than the inner track, and the station is located halfway the inner track and halfway the outer track. The ride is configured such that a vehicle that leaves the station on the outer track enters the station on the inner track (which trajectory is indicated with the full line), and visa versa, and thus travels the same distance as a vehicle which leaves the station on the inner track and enters the station on the outer track. Furthermore, when a vehicle on the inner track and a vehicle on the outer track leave the station at the same moment and follow the track with the same speed, they will travel the single track one behind the other and enter at the station at the same moment.

In an alternative embodiment, a vehicle which leaves the station on the inner track enters the station on the inner track. In such an embodiment, preferably the outer track and the inner track are of equal length, and the track lay out is such that the length of the inner track from the station to the single track is smaller than the length of the outer track from the station to the single track. When a vehicle on the inner track and a vehicle on the outer track leave the station at the same moment and follow the track with the same speed, they will travel the single track one behind the other and return at the station at the same moment.

In an alternative embodiment, the ride is for example provided with multiple closed loop single tracks, preferably of the same length, which are located concentric within the ride such that multiple parallel tracks are provided.

In a preferred embodiment of a ride according to the invention the position of the carrier is linked to the scenery of the ride.

For example when the ride provides a scene of a car or train moving towards the vehicle, the carrier is pitched backward to provide the passengers with the feeling they car or train runs them over. On the ceiling the bottom of a moving car or train can be projected to further enhance the experience. When the vehicle encounters a huge tree blocking the track, the carrier can be tilted from a neutral position into a pitched forward position to provide the passengers with the feeling of an emergency stop. When the ride provides a scene with a storm or hurricane, the carrier can be rotated about its vertical axis to provide the passengers with a spinning sensation to enhance the experience being sucked into the storm.

Furthermore, by rotating the carrier such that the passengers face sideways with respect to the direction of movement of the vehicle, the passengers can be provided with a full view of the scenery. In traditional vehicles, the passengers' position is fixed with passengers facing forward. Thus, the scenery presented always comprises a view of the track the vehicle follows, which disturbs the scenery and prevents the passengers from fully emerging into the experience.

Furthermore, the ability of the vehicle to rotate the carrier about a vertical axis allows for a more flexible design of the scenery of the ride. With a traditional vehicle in which the passengers are in a fixed position facing forward, the scenery of a ride is distributed on both sides of the track. With a vehicle according to the invention a carrier can be rotated such that the passengers face one side of the track, providing the passengers with a full view of the scenery. The other side of the track, which is out of sight of the passengers, does not need to be provided with scenery, which saves costs.

Furthermore, the carrier can be positioned during the ride such that the passengers face away from objects which may take them out of the experience created by the ride. For example, when the ride shows a forest scenery, concrete support structures destroy the experience of being in a real forest. In practice it may not always be possible, or only at extreme costs, to hide such functional objects behind scenery. With a vehicle according to the invention the carrier can be pivoted to turn the passengers away form such an object.

When the track of a ride runs along a wall, structural support or functional equipment, etc. located on the left side of the track, the carrier of a vehicle can be positioned such that the passengers face away from the object and face a scenery on the right side of the track. Also, when for example the track layout and/or the speed of the two vehicles is such that the vehicles come in sight of one another, the carriers can be positioned such that the passengers face away form the other vehicle and face towards the scenery along the side track. Thus the passengers are transported along the track of the ride without being shown objects or vehicles which may ruin their experience of the ride.

Also, by rotating the carrier while passing a scene, the position of the passengers can be adjusted such that the continuously face the scenery while passing it. Thus there is more time for the passengers to experience the particular scene, while the vehicle moves towards the next scene.

Furthermore, the possibility of the carrier to be lifted and lowered allows for a ride to be provided with different scenes located one above the other. For example, when the carrier is in its lowered position the passengers are provided with a view of an underground world, and when the carrier is lifted into its raised position the passengers are provided with a view of an world above ground, which scenery is located above the scenery of the underground world. Alternatively, the ride may comprise multiple scenes for telling a story, and which are stacked in an array of cells. Such a ride is known from WO2006049484. The cells thus form a wall of stacked scenes. During the ride the passengers are moved along the cells, or along a section of the cells. Since a vehicle according to the invention is capable of lifting, lowering and moving multiple passengers sideways, it is highly suitable for use in such a ride.

Also the movement of the carrier allows to actively manipulate the viewing direction of the passengers when presented with a scene, for example to direct them to a part section of the scenery which is important for a story being told. Also the carrier can be used to help the passengers follow the movement of a figure through the scenery, for example from left to right for a creature running through a landscape scenery, or moving and/or tilting upward to follow a creature climbing into a tree.

Thus a vehicle according to the invention does not only allow to enhance the excitement of the passengers by lifting, tilting and preferably rotating the passengers relative to the movable base, it can also be used in telling a story and allows a more flexible lay out of the experience and thus to enhance the experience of the ride.

In a practical embodiment a vehicle according to the invention comprises a movable base adapted to ride over a substructure, for example a support surface, rails or track. The vehicle furthermore comprises a support, mounted on the movable base, which support pivotably supports a lift arm, wherein the pivot axis is located at a height of at least 3 meters above the substructure, for example about 3.2 meters above the substructure.

Preferably the support is rotatably mounted on the movable base, and the first and second pivot axis, connecting the lift arm to the support and to the carrier respectively, are located on opposite sides of the vertical pivot axis.

The lift arm of a vehicle according to the invention is preferably with one end pivotably connected to the support, and with its other en pivotably connected to the carrier for supporting the passengers, wherein preferably the both pivot axis run parallel. In a practical embodiment the distance between these two pivot axis is at least 3 meters, for example 3.2 meters. Preferably, the lift arm is capable of lifting the carrier over a vertical distance of at least 3 meters, for example 3.5 meters.

With a preferred embodiment according to the invention the hinge pivot axis of the lift beam is supported at a distance above the movable base, such that the full reach of the carrier, from its lowered position to its raised position, can be obtained with activating the actuators for the lift arm only. In the preferred embodiment shown in FIG. 1, the horizontal axis, i.e. the pivot axis 10 connecting the lift arm 4 and the support 3, is fixed at a constant height above the movable base. Thus, the pivot axis 20, indicated in FIG. 2, connecting the carrier and the lift arm can be lowered to a position (shown in FIG. 6) below the fixed pivot axis 10, and can be lifted to a position (shown in FIG. 5) above the fixed pivot axis 10 connecting the support arm and the lift arm.

Furthermore, the lift arm 4 can be folded in between the support 3 and the carrier 5, when the carrier is in its lowered position (shown in FIG. 6). Thus the vehicle 5 has a compact and stable configuration when the carrier is lowered. In an alternative embodiment, the lift arm is located alongside the support arm, such that when the carrier is in the lowest position both the support arm and the lift arm are located adjacent the carrier.

In a practical embodiment, the carrier has a width of at least 5 meters, for example about 5.2 meters, and supports 3 rows of 4 seats on each side of a central access path.

In a further embodiment the movable base is supported by three support devices for supporting the movable base on the substructure, which support devices are at specially separated locations, and wherein the centre of gravity of the vehicle is at all times located within a triangular shape connecting the three separate locations. Thus the vehicle is stably supported.

In a preferred embodiment of a vehicle according to the invention, the actuator, e.g. electrical drive, electric cylinder, hydraulic cylinder or pneumatic cylinder, for lifting/lowering and for adjusting the pitch is located on the base or support. Thus the centre of gravity of the vehicle is located near the ground, also when the carrier is in a lifted position.

With a vehicle according to the invention it is possible to move the carrier up and down as well as pitch the carrier relative to the movable base, independent of the movement of the movable base along a track. In a preferred embodiment, the vehicle is provided with a control unit or ride control device which controls the movement of at least the carrier. The actuators are preferably provided with position sensors that provide information to the control device which controls the movement of the carrier and optionally the vehicle.

In a preferred embodiment the vehicle is provided with a program memory that is coupled to and accessed by a ride control device, and which provide information to the control device on how to move the carrier, for example based on the position of the vehicle in the ride or an action or effect, for example a sound effect, performed as part of the ride and/or the scenery along the guide track the vehicle is following.

In the preferred embodiment shown, the actuators for lifting the arm and pivoting the carrier comprise each two parallel mounted hydraulic cylinders. In a preferred embodiment, an actuator comprises two or more hydraulic, pneumatic or electric cylinders, wherein each cylinder is capable of providing enough power to perform the function of the actuator, such that the actuator is able to function while only one or some of the cylinders it comprises is/are active. Thus, one or more of the cylinders of an actuator can be inactive while the carrier can still be lifted and pivoted.

Preferably, the first and second actuator comprise hydraulic or pneumatic cylinders and the vehicle is provided with an electrically powered hydraulic or pneumatic system for activating these cylinders. In a further preferred embodiment, the support is rotatable mounted on the base and rotated by way of a hydraulic or pneumatic actuator, preferably part of an electrically powered hydraulic system.

Furthermore, preferably the vehicles are provided with adjustable drives for moving the vehicles at different speeds. Thus the position of the vehicles on the track and relative to each other can be adjusted without the need of a particular track lay out.

In an alternative embodiment, an actuator comprises for example one single cylinder, or a drive, or other suitable alternative for pivoting the lift arm relative to the base or for pivoting the carrier relative to the lift arm.

An example of an electric drive for positioning the carrier is an electric cylinder, an electro motor or a steppen motor, or any other electric drive suitable for pivoting the support arm, pivoting the carrier or rotating the support about a vertical axis.

The invention claimed is:

1. Amusement ride vehicle for transporting multiple passengers, comprising:

a movable base adapted to ride over a substructure;

a support, mounted on the movable base;

a lift arm, pivotably connected to the support for pivoting relative to the support about a horizontal axis;

a carrier supporting multiple passenger seats and comprising a restraining device adapted to restrain each individual passenger in a seat, said carrier being pivotably supported by the lift arm for pivoting relative to said lift arm about a horizontal axis;

a first actuator for pivoting the lift arm relative to the support, and thus for lifting and lowering the carrier relative to the movable base while the movable base rides over the substructure;

a second actuator for pivoting the carrier relative to the lift arm, and thus for adjusting a pitch of the carrier relative to the movable base while the movable base rides over the substructure; and a pitch adjustment boom, the pitch adjustment boom being pivotably connected to the carrier at one end and connected to the second actuator at an opposite end for pivoting the carrier, such that the pitch of the carrier can be adjusted by moving the pitch adjustment boom along an longitudinal axis thereof, wherein the pitch adjustment boom is pivotably connected to the second actuator via a linkage member, the linkage member being pivotably connected to said opposite end of the pitch adjustment boom, being pivotably connected to the second actuator, and being pivotably connected to the support, wherein the carrier has a neutral position in which the passenger seats are supported in an upright position relative to the movable base, and wherein the carrier is pivotable into a pitched forward position, in which the seats are tilted forward, and/or into a pitched backward position in which the seats are tilted backward, to enhance the sense of excitement of the passengers.

2. Vehicle according to claim 1, wherein the carrier can be pivoted between a pitched forward position in which the seats are at an angle of 25 degrees or more, relative to the seats when in the neutral position, and/or a pitched backward position in which the seats are at an angle of 30 degrees or more relative to the seats when in the neutral position.

3. Vehicle according to claim 1, wherein the pivot axis at which the lift arm is connected to the support is fixed at a constant height above the movable base, and wherein the pivot axis connecting the carrier to the lift arm is located below the fixed pivot axis when the carrier is in a fully lowered position and, and is located above the fixed pivot axis when the carrier is in a fully raised position.

4. Vehicle according to claim 1, wherein the support is a support arm mounted on the movable base such that a longitudinal axis of the support arm extends at an angle relative to a vertical axis.

5. Vehicle according to claim 1, wherein the second actuator comprises one or more pneumatic cylinders, hydraulic cylinders or electric cylinders, connected with one end to the linkage member and with its opposite end to the support.

6. Vehicle according to claim 1, wherein the first actuator comprises one or more pneumatic cylinders, hydraulic cylinders, or electric cylinders, connected with one end to the support and with its opposite end to an end of the lift arm.

7. Vehicle according to claim 6, wherein the lift arm is connected with one end to the carrier and with an opposite end to the first actuator, and wherein the two ends of the lift arm are located on opposite sides of the pivot axis of the lift arm.

8. Vehicle according to claim 1, wherein the pivot axis connecting the carrier to the lift arm is located near a center of the carrier, when seen in side view, such that when the carrier is pivoted, one end of the carrier moves in a direction opposite to the direction of movement of the opposite end of the carrier.

9. Vehicle according to claim 1, wherein the support is provided with a guide surface for guiding the carrier into the neutral position while being lowered into a lowest position of the carrier.

10. Vehicle according to claim 1, wherein, when the carrier is in a lowest position, the lift arm is folded in-between the support and the carrier.

11. Vehicle according to claim 1, wherein the carrier comprises a stand with seats located at different heights relative to the movable base when the carrier is in the neutral position.

12. Vehicle according to claim 1, wherein the vehicle is further provided with a drive for driving the vehicle over the substructure.

13. Vehicle according to claim 1, wherein the vehicle comprises a computer control unit for controlling the first and second actuator.

14. Vehicle according to claim 1, wherein the movable base is supported by three support devices for supporting the movable base at the substructure, which support devices are at specially separated locations, and wherein the centre of gravity of the vehicle is at all times located within a triangular shape connecting the three separate locations.

15. Amusement ride comprising:

multiple vehicles according to claim 1;

a track, preferably a closed loop track; and a station along the track where the ride begins and/or ends, for boarding and/or disembarking of the one or more vehicles by passengers.

16. Amusement ride according to claim 15, wherein the track comprises an inner track and an outer track such that a first vehicle riding the inside track can ride next to a second vehicle riding the outside track, and wherein the vehicles are provided with a rotatably mounted support on the movable base for rotating the carrier about a vertical axis to position the seats such that the passengers sitting in the seats of the vehicle on the inside track face the passengers sitting in the vehicle on the outer track and visa versa.

17. Amusement ride according to claim 16, wherein the inside and outside tracks are located within the station, and each of the carriers comprises a stand with seats located at different heights relative to the movable base when the carrier is in the neutral position, and wherein the stands of the vehicles are rotated towards each other at the beginning and/or the ending of the ride.

18. Amusement ride according to claim 17, wherein the inside and outside tracks after leaving the station unite into a single track, on which the vehicles ride one behind the other, and split into the inside and outside tracks prior to entering the station.

19. Amusement ride comprising a track; and at least two vehicles according to claim 1 for moving along a track.

20. Amusement ride according to claim 19, further comprising a station along the track for boarding and/or disembarking of the one or more vehicles by the passengers, and wherein the track prior to the station splits from a single track into a an inner track and an outer track, which inner and outer track after the station reunite into the single track; and wherein the station is designed for receiving the vehicles for disembarking and/or boarding, with the carrier of a vehicle in the inner track positioned such that the passengers in the seats face the passengers in the vehicle on the outer track and visa versa.

21. Amusement ride according to claim 20, wherein the outer track is longer than the inner track or visa versa, and wherein the station is located halfway the inner track and halfway the outer track, such that a vehicle which leaves the station on the outer track and enters the station on the inner track travels the same distance as a vehicle which leaves the station on the inner track and enters the station on the outer track, and when a vehicle on the inner track and a vehicle on the outer track leave the station at the same moment and follow the track with the same speed, they will travel the single track one behind the other and return at the station at the same moment.

22. Method for providing a ride experience in an amusement ride comprising the steps of:

providing an amusement ride vehicle according to claim 1;

pivoting the lift arm relative to the support, and thus for lifting and lowering the carrier relative to the movable base while the movable base rides over the substructure;

pivoting the carrier relative to the lift arm, and thus for adjusting a pitch of the carrier relative to the movable base while the movable base rides over the substructure; and adjusting the pitch of the carrier by moving the pitch adjustment boom along the longitudinal axis thereof.

23. Vehicle according to claim 1, wherein the support is mounted rotatably on the movable base for rotating about a vertical axis.

24. Vehicle according to claim 1, wherein the linkage member is pivotally connected to the horizontal axis at which the lift arm is pivotably connected to the support.

25. Amusement ride vehicle for transporting multiple passengers, comprising:

a movable base adapted to ride over a substructure;

a support, mounted on the movable base;

a lift arm, pivotally connected to the support for pivoting relative to the support about a horizontal axis;

a carrier supporting multiple passenger seats and comprising a restraining device adapted to restrain each individual passenger in a seat, the carrier being pivotally supported by the lift arm for pivoting relative to said lift arm about a horizontal axis;

a first actuator for pivoting the lift arm relative to the support, and thus for lifting and lowering the carrier relative to the movable base while the movable base rides over the substructure; and a second actuator for pivoting the carrier relative to the lift arm, and thus for adjusting a pitch of the carrier relative to the movable base while the movable base rides over the substructure, wherein the carrier has a neutral position in which the passenger seats are supported in an upright position relative to the movable base, and wherein the carrier is pivotable into a pitched forward position, in which the seats are tilted forward, and/or into a pitched backward position in which the seats are tilted backward, to enhance the sense of excitement of the passengers, and wherein the support is provided with a guide surface for guiding the carrier into the neutral position while being lowered into a lowest position of the carrier.

* * * * *